United States Patent [19]

Bierling et al.

[11] Patent Number: 4,870,990

[45] Date of Patent: Oct. 3, 1989

[54] DOUBLE-FLOW BUTTERFLY VALVE PART

[75] Inventors: Rudolf Bierling, Schwaigern; Max Ruf; Wilhelm Hannibal, both of Neckarsulm, all of Fed. Rep. of Germany

[73] Assignee: Audi AG, Neckarsulm, Fed. Rep. of Germany

[21] Appl. No.: 312,955

[22] Filed: Feb. 17, 1989

[30] Foreign Application Priority Data

Feb. 18, 1988 [DE] Fed. Rep. of Germany ..... 3805038

[51] Int. Cl.[4] ..... F02D 9/02; F02M 11/02

[52] U.S. Cl. ..... 137/595; 137/630.2; 261/41.3

[58] Field of Search ..... 137/595, 628, 630.2; 261/23.2, 41.3

[56] References Cited

U.S. PATENT DOCUMENTS

| | | | |
|---|---|---|---|
| 2,790,631 | 4/1957 | Carlson et al. | 261/23.2 |
| 3,259,376 | 7/1966 | Baer | 137/630.2 X |
| 3,390,921 | 7/1968 | Klimek | 137/630.2 X |
| 3,913,621 | 10/1975 | Damratowski | 137/630.2 |
| 4,393,827 | 7/1983 | Schmid | 261/23.2 X |

*Primary Examiner*—Stephen M. Hepperle

*Attorney, Agent, or Firm*—Kane, Dalsimer, Sullivan Kurucz, Levy, Eisele & Richard

[57] ABSTRACT

A double-flow butterfly valve part (1) contains two butterfly valves (4 and 6), which are connected together by means of a coupling element (10). The second butterfly valve (6) is opened only when the first butterfly valve (4) is moved beyond a partially open position into the completely open position. To make it possible to shift the two butterfly valves (4 and 6) back by means of a single restoring spring acting on the first butterfly valve (4), a desmodromic control is provided between the coupling element (10) and the second butterfly valve (6). For this purpose, a lever (9) is disposed on the shaft (7) of the second butterfly valve (6). This lever (9) contains an arched slot (12), which is engaged by a roller (13) mounted in the coupling element (10). The coupling element (10), in turn, is provided with an arched slot (14), which is engaged by a roller (15) mounted in the lever (9).

5 Claims, 2 Drawing Sheets

DOUBLE-FLOW BUTTERFLY VALVE PART

BACKGROUND OF THE INVENTION

The invention relates to a double-flow butterfly valve part. Butterfly valve parts are known, for example from such disclosures as EP-B No. 0012598. When the gas pedal is activated in this known valve part, it is intended that a gradual and readily controllable increase in power of an internal combustion engine is achieved. This is of advantage especially in the case of high-performance internal combustion engines for driving motor vehicles to prevent the driving wheels spinning when starting off and to make sensitive reversing possible. In the known butterfly valves parts, the two butterfly valves are closed by the action of their own springs. Consequently, when the gas pedal is depressed, at first the force of the spring for the first butterfly valve must be overcome and, after the pedal has traversed a certain path, the force of the spring for the second butterfly valve must be overcome additionally, as a result of which the force exerted on the pedal must be increased suddenly. When allowing the gas pedal to retract, the two butterfly valves are closed consecutively by their springs. Corresponding to the coupling between the two butterfly valves, the second butterfly valve is normally closed first after a pedal path of about 40%. As the pedal is allowed to retract further up to its final position, that is, after a further 60% of pedal path, the first butterfly valve reaches its closing position. Should the spring of the second butterfly valve break, the second butterfly valve, as the gas pedal is allowed to retract, is moved in the closing direction by the spring of the first butterfly valve over the rod linkage, however only after a free play of about 10° and then synchronously with the first butterfly valve. If the spring breaks, it will be apparent that the second butterfly valve will reach its end position together with the first butterfly valve, so that the response and operational behavior of the internal combustion engine falls off appreciably in quality compared to the normal state.

SUMMARY OF THE INVENTION

It is therefore an object of the invention to provide a butterfly valve of the generic type, with which a relatively low pedal force is required to open both butterfly valves and which ensures that the second butterfly valve always reaches its closed position when the gas pedal moves back by a certain amount, for example, by 40% of its pedal path from full-load position.

With the butterfly valve part of the present invention, the forced control of the second butterfly valve necessarily causes the second butterfly to reach its closed position through the agency of the spring, which is assigned to the first butterfly valve, when the first butterfly valve, on retraction of the gas pedal, has reached the position, in which the second butterfly valve is opened as the gas pedal is depressed. Due to the omission of a spring that is assigned specifically to the second butterfly valve, the pedal force is determined exclusively by the force by the spring assigned to the first butterfly valve. Thus, there is no unsteadiness in the course of the pedal force.

Further advantages will become apparent from the following description which is to be taken in conjunction with the accompanying drawings.

DETAILED DESCRIPTION

Figure 1:
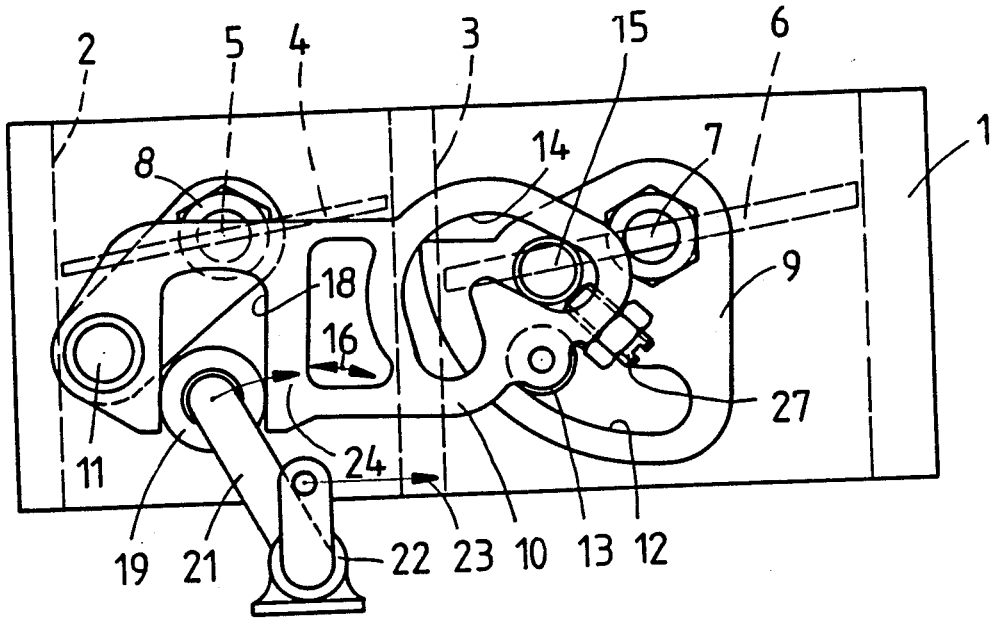
FIG. 1 shows a side view of a double-flow butterfly valve part.
Figure 3:
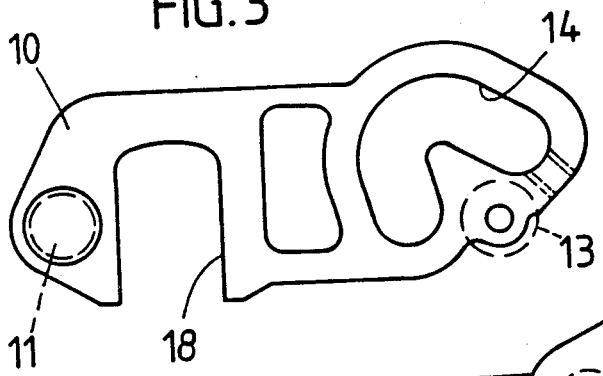
FIG. 3 shows a projection of the coupling element.
Figure 4:
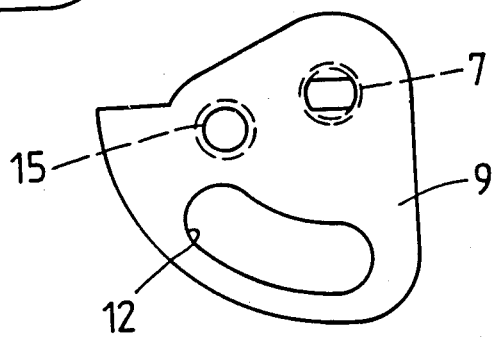
FIG. 4 shows a projection of lever seated on the shaft of the second butterfly valve.
Figure 2:
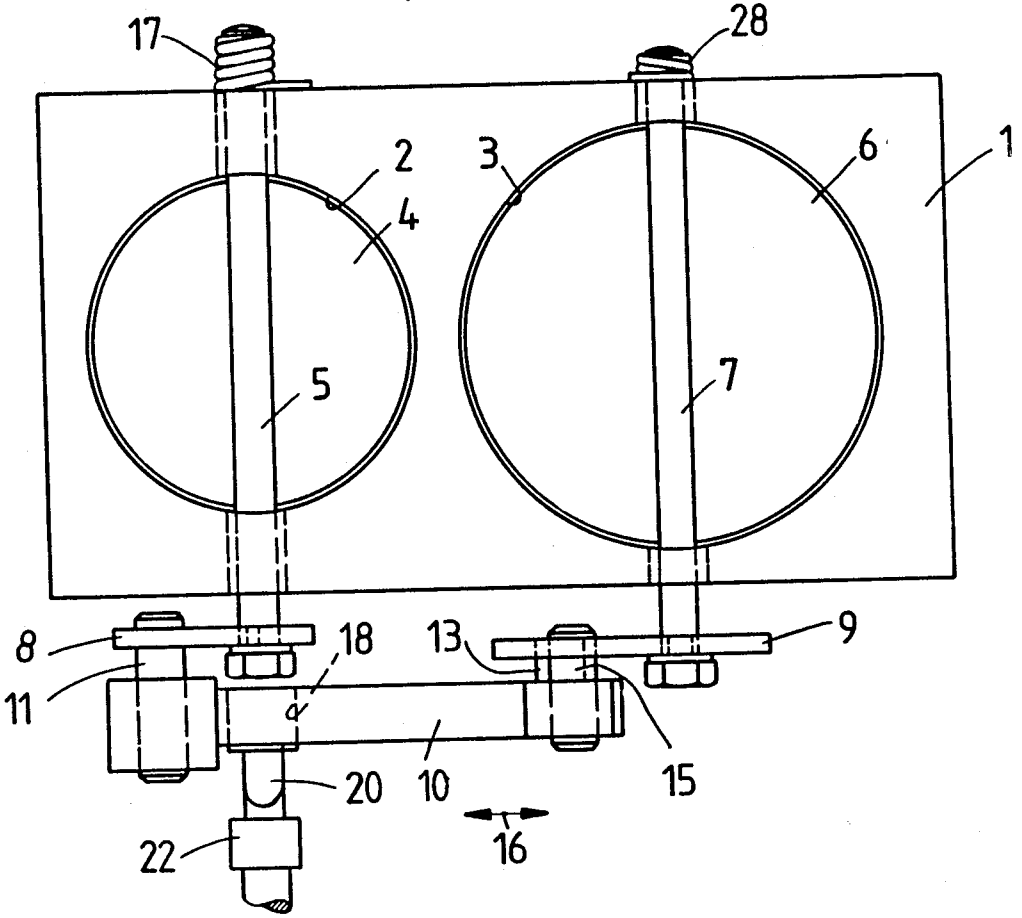
FIG. 2 shows a plan view of the butterfly valve part of FIG. 1.

In FIGS. 1 and 2, the housing 1 of the butterfly valve part has a first flow channel 2 and a second flow channel 3 of larger diameter. In flow channel 2, a first butterfly valve 4 is disposed on a shaft 5 and in the second flow channel 3 a second butterfly valve 6 is disposed on a shaft 7. A first lever 8 is mounted on shaft 5 and a second lever 9 on shaft 7. The two levers 8, 9 are each non-rotatably mounted on their respective shafts and are interconnected by the coupling element 10. The first lever 8 is connected to the coupling element 10 by means of a swivel pin 11, while a desmodromic control is provided between the coupling element 10 and the second lever 9. For this purpose, the second lever 9 is provided with a first arched slot 12, which is engaged by a roller 13 that is rotatably mounted in the coupling element 10 and the coupling element 10 is provided with a second arched slot 14, which is engaged by roller 15 that is rotatably mounted in the second lever 9. The distance between the center of the roller 13 and the shaft 7 corresponds approximately to the distance between the center of the swivel pin 11 and the shaft 5. The arched slot 12 and the roller 13 serve to guide the coupling element 10.

The desmodromic control is constructed so that, when the coupling element 10 is shifted in the direction of the double arrow 16, the second butterfly valve 6 is forcibly shifted in the opening as well as in the closing sense, as will be described in detail later.

On shaft 5 of butterfly valve 4, there is a restoring spring 17, which endeavors to bring back the first butterfly valve 4 and, over the coupling element 10, also the second butterfly valve 6 after a displacement into its closed position. The swiveling of the butterfly valves 4 and 6 in the opening direction is accomplished by shifting the coupling element 10 in FIGS. 1 and 2 to the right out of the idling position shown. For this purpose, the coupling element 10 is provided with a U-shaped cutout 18, which is engaged by a roller 19, which is seated on the offset end 20 of an activating rod linkage 21. The rod linkage is supported in a schematically indicated bearing 22 and can be rotated in this bearing by a pull in the direction of the arrow 23. As a result, the roller 19 is moved in the direction of the arrow 24 and the coupling element 10 is shifted to the right.

The two arched slots 12 and 14 are so constructed and the two rollers 13 and 15 are so disposed that, as the coupling element 10 is shifted from the idling position shown in FIG. 1 to the right, only the first butterfly valve 4 is opened at first by the first lever 8. After a shift of the first coupling element 10 corresponding to an angle of rotation of the first butterfly valve 4 of, for example 25°, the second lever 9 is now also shifted by arched slot 14 through roller 15, until the two butterfly valves 4 and 6 are completely open in the true end position of the coupling element 10. By changing the contour of the arched slot 14, the rotation of the butterfly valve 6 can be changed relative to the rotation of the butterfly 4 and adapted to the given conditions.

An adjusting screw 27 is provided for the basic adjustment of the second butterfly valve 6. It is screwed into a threaded throughhole in the coupling element 10 and is supported on the roller 15, which is mounted in the second lever 9.

The desmodromic forced guidance of the second lever 9 by means of rollers 13, 15 ensures that the second butterfly valve 6 carries out the swiveling motion specified by the shape of the arched slot 14 in the opening as well as in the closing sense without hysteresis. Due to the this forced guidance of the lever 9, the return movement of the two butterfly valves 4 and 6 can be accomplished by means of a single restoring spring 17.

The rollers 13 and 15 are guided with the least possible clearance in the arched slots 12 and 14 respectively. Since an absolutely clearance-free engagement cannot be maintained in the long run, it is advisable to provide a weak clearance-compensating spring 28 on the shaft 7 of the second butterfly valve 6. This weak clearance compensating spring 28 acts on the second butterfly valve 6 in the sense of closing it. It is so weak that it does not noticeably increase the pedal force required to open the butterfly valves.

Thus, the several aforementioned objects and advantages are most effectively attained. Although a single somewhat preferred embodiment has been disclosed in detail herein, its scope is to be determined by the appended claims.

We claim:

1. A double-flow butterfly valve part having a first flow channel with a first butterfly valve, a second flow channel with a second butterfly valve, having a shaft means for swiveling the first butterfly valve, a rod linkage for connecting the shaft of the first butterfly valve with the shaft of the second butterfly valve in such a manner that the second butterfly valve commences to open up only when the first butterfly valve is moved beyond a partially open position and is then moved together with the first butterfly valve into a completely open position, and spring means which urges the two butterfly valves to return to their closed position, the rod linkage having a first lever that is non-rotatably connected to the first butterfly valve shaft and a second lever that is non-rotatably connected to the second butterfly valve shaft, the levers being connected together by means of a coupling element, the lines of action of the two levers are parallel to one another in the open position and in the closed position of the butterfly valves, the second lever has a first arched slot, which is engaged by a roller disposed on the coupling element, the coupling element has a second arched slot, which is engaged by a second roller disposed on the second lever, the two arched slots being so shaped and the two roller being so disposed, that the coupling element forcibly shifts the second butterfly valve in the opening direction as well as in the closing direction, and the spring means being coupled with the first butterfly valve or a member non-rotatably connected there to.

2. The butterfly valve part of claim 1, wherein the means for swiveling the first butterfly valve engage the coupling element.

3. The butterfly valve part of claim 2, wherein the coupling element has a U-shaped cut-out, which is engaged by one end of a pivoted lever, which can be swiveled by a rod linkage.

4. The butterfly valve part of claim 1, wherein a clearance compensating spring, acting on the second butterfly valve is provided urging it toward a closed portion.

5. The butterfly valve of claim 1, wherein an adjusting screw, acting on the roller mounted on the second lever, is disposed on the coupling element.

* * * * *